US007073687B2

(12) United States Patent
Chang

(10) Patent No.: US 7,073,687 B2
(45) Date of Patent: Jul. 11, 2006

(54) MULTI-FRONT FRONT CATCH PLATE DESIGN FOR VARIOUS MULTI-COMPONENT CARTRIDGES

(76) Inventor: Peter J. Chang, 11001 Petersborough Dr., Rockville, MD (US) 20852

( * ) Notice: Subject to any disclaimer, the term of this patent is extended or adjusted under 35 U.S.C. 154(b) by 237 days.

(21) Appl. No.: 10/625,150

(22) Filed: Jul. 23, 2003

(65) Prior Publication Data

US 2005/0019172 A1 Jan. 27, 2005

(51) Int. Cl.
*B67D 5/52* (2006.01)

(52) U.S. Cl. ..... 222/137; 222/145.5; 222/326

(58) Field of Classification Search ..... 222/137, 222/145.5, 145.6, 326, 327
See application file for complete search history.

(56) References Cited

U.S. PATENT DOCUMENTS 4,295,409 A * 10/1981 Simpson ..... 86/31
4,753,536 A * 6/1988 Spehar et al. ..... 366/339
5,197,635 A 3/1993 Chang
5,924,600 A * 7/1999 Keller ..... 222/137
6,234,994 B1 * 5/2001 Zinger ..... 604/82
6,290,101 B1 9/2001 Chang
6,311,869 B1 * 11/2001 Horth et al. ..... 222/137
6,401,988 B1 * 6/2002 Parent et al. ..... 222/326
6,464,109 B1 10/2002 Harris
6,527,203 B1 3/2003 Hurray
2002/0145015 A1 10/2002 Nelson

* cited by examiner

*Primary Examiner*—Joseph A. Kaufman
(74) *Attorney, Agent, or Firm*—Ober/Kaler; Royal W. Craig

(57) ABSTRACT

An front catch plate for manual, pneumatic or battery powe-operated dual-barrel dispensing guns of the type having a pair of laterally-displaced and adjustable plunger shafts with end-mounted pistons for extruding compound from both cartridges of a variety of sizes of twin cartridge packs. In one embodiment, the front catch plate accepts the cartridge neck from an opening on the top side of the front catch plate. A plastic insert is attached to the front catch plate and provides a custom fit base for the specific form, shape and size of the cartridge neck used. There is a separate plastic insert for each different commercially available dual cartridge. In this embodiment, the front catch plate will generally be manufactured as one piece with the carriage. In another embodiment, the front catch plate accepts the cartridge neck from an opening on the side of the front catch plate. After the cartridge neck is inserted into the front catch plate opening, a adjustable centering stop is then inserted onto the front catch plate to secure the cartridge neck in place for application.

6 Claims, 4 Drawing Sheets

MULTI-FRONT FRONT CATCH PLATE DESIGN FOR VARIOUS MULTI-COMPONENT CARTRIDGES

BACKGROUND OF THE INVENTION

1. Field of the Invention

The present invention relates to dual-component caulking guns (such as for epoxy and resin) and, more particularly, to a universal manual, pneumatic or battery power-operated caulking gun for use with a variety of differently-sized dual component cartridges.

2. Description of the Background

There are a wide variety of caulking guns that are used to dispense many types of fluid compositions such as urethane, vinyl, polyester, epoxy and other plastics. Conventional caulking guns have a barrel or carriage which seats a cartridge containing the fluid composition, the cartridge having a dispensing nozzle at one end These caulking guns typically have a plunger shaft that is driven by a trigger either manually or by battery or pneumatic power. A piston is mounted at the end of the plunger shaft, and operation of the trigger moves the plunger shaft and piston through the cartridge to urge compound there from.

In some cases, such caulking guns are adapted for use with a double cartridge for dispensing two-component chemical systems such as epoxy, sealant, and adhesive dispensers, which are used in automotive, concrete, and other industrial bonding applications where structural integrity is highly demanded. Unfortunately, there currently is no packaging standard for double cartridges. The cartridges and, especially, the neck of the cartridges come in different shapes, forms, and sizes, depending on the manufacturer. Thus, manufacturers typically sell their own dedicated dispensing gun for their own double-cartridge products. Due to the variety of cartridges, there is no universal dispensing gun or dispensing tool. Consequently, users need to inventory several dedicated tools to use a variety of the commercially available dual cartridge dispensers.

A few prior efforts have been directed toward solving this problem. For example, U.S. Pat. No. 6,464,109 to Harris issued Oct. 15, 2002 discloses a caulking gun with a mechanism for positioning and securing the variously shaped- and sized-necks of a wide variety of cartridges utilizing a threaded rod and thread-bored stop which can be positioned to apply pressure to the nozzle end of the cartridge, thus securing the nozzle in place. However, Harris '109 does not teach a method or mechanism for securing dual cartridges.

Also of interest is U.S. patent application Publication No. 2002/0145015 to Nelson published on Oct. 10, 2002. The Nelson publication discloses a caulking gun carriage that is adjustable to accommodate one, two, or more cartridges. Nelson includes one potential configuration for the nozzle end of the gun carriage (see FIGS. 1–8 therein), but it does not teach a mechanism or method for securing multiple cartridges with differing neck shapes and sizes.

U.S. Pat. No. 6,527,203 to Hurray et al. issued Mar. 4, 2003 teaches a two-component dispensing gun that receives two separate cartridge nozzles and dispenses one flow of mixed fluid. Hurray et al. '203 does not teach a mechanism capable of accommodating necks of different shapes and sizes.

It would be greatly advantageous to provide a dual-cartridge type gun that can accommodate and secure a range of the various-sized commercially available dual compound cartridges and that exhibit varying neck shapes and sizes.

U.S. Pat. Nos. 5,197,635 and 6,290,101 to the inventor herein and issued on Mar. 30, 1993 and Sep. 18, 2001, respectively, teach a dual-cartridge type dispenser gun that can accommodate various-sized commercially available dual-compound cartridges, and a means to secure the various dual cartridges in place despite fixed-size carriages. Unfortunately, neither patent teaches a mechanism for securing different shaped and sized necks in place for accurate application.

Consequently, there remains a need for a dual-cartridge dispensing gun that includes a mechanism for exposing and securing various sized and shaped cartridge necks without having to touch, adjust, change or remove the securing components for any reason.

SUMMARY OF THE INVENTION

It is, therefore, an object of the present invention to provide a dual-cartridge dispensing gun having a universal front front catch plate to accommodate various sizes and shapes of cartridge necks of the dual-cartridge format. The universal front front catch plate may be used in conjunction with U.S. Pat. No. 6,290,101 Cartridge Stabilizing Plate for Dual Barrel Dispensers and U.S. Pat. No. 5,197,635 Variable Thrust Caulk Dispensing Device to give a truly adaptable dual-cartridge dispensing gun.

It is another object to provide a front front catch plate as described above that accommodates a range of different cartridge neck shapes and sizes, thereby avoiding the need to change dispensing guns each time that the size or shape of the nozzle of the cartridge(s) changes.

It is a further object to provide a front front catch plate as described above that can be economically manufactured and installed onto a single or dual-cartridge dispensing gun using a minimum of time and materials.

According to the present invention, the above-described and other objects are accomplished by providing a front catch plate for a dual-cartridge dispensing gun of the type for extruding compound from both cartridges of a variety of sizes of dual cartridge packs. The front catch plate fixes to the neck of the application end of the carriage and provides an opening capable of exposing and securing any size and shape of neck for single or dual-cartridge applications. The front catch plate is capable of accommodating a range of different cartridge neck sizes, thereby avoiding the need to switch dispensing guns each time that a cartridge with a different sized or shaped neck is used.

In one embodiment, the front catch plate is formed with an upwardly-directed yoke that secures the cartridge neck, leaving the protruding cartridge nozzle exposed. Each cartridge or set of commercially available dual cartridges has a corresponding plastic insert associated with it. The plastic insert slides down into the yoke of the front catch plate and provides the proper shape for securing the cartridge neck in place and aligning the nozzles to provide accurate application of the compound. The cartridge neck slides down upon the appropriate insert and is thus secured for use.

In a second embodiment, the front catch plate is formed in an elongated 'C' shape, with a laterally-oriented yoke. The yoke has a multi-grooved edge for slidable insertion of plastic inserts to adapt to a variety of cartridge neck forms, shapes and sizes. A plastic insert is then slid into the yoke until it pushes against the neck of the cartridge, thus securing the cartridge in place for use. The lateral yoke allows for lateral, or side, loading of the cartridge.

Both front catch plate embodiments can be adapted to accommodate a range of different cartridge sizes, requiring only the proper plastic insert be installed onto the front catch plate before use. Moreover, the front catch plate can be economically manufactured of metal or molded plastic or other appropriate material and installed onto a single or dual-barrel dispensing gun at minimal additional cost of time and materials. Additionally, both embodiments may be used in conjunction with the stabilizing plate taught in U.S. Pat. Nos. 6,290,101 and 5,197,635 to the inventor herein to provide a truly adaptable dispensing gun.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

The basic design concept embodied in the present invention is a front catch plate for a dispensing gun that accommodates any form, shape or size dual cartridge neck, and secures said cartridges for application of the contained compound.

Figure 1:
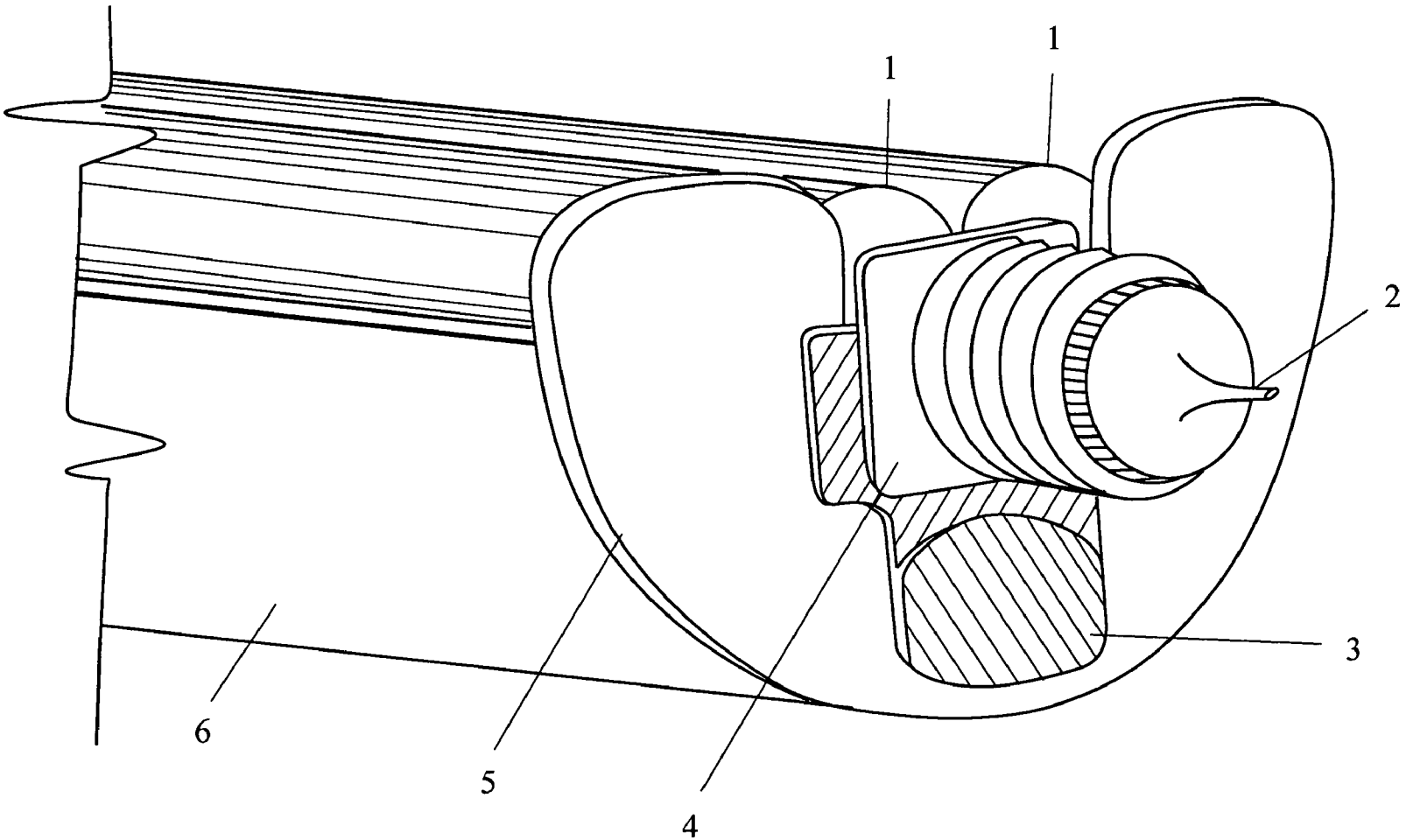
FIG. 1 is a front perspective view of a dual-cartridge dispensing gun incorporating a top-loading front catch plate 5 according to one embodiment of the present invention.

FIG. 1 is a front perspective view of a dual-cartridge dispensing gun incorporating a top-loading front catch plate 5 according to one embodiment of the present invention. The top-loading front catch plate 5 is generally U-shaped to define an upwardly directed yoke for receiving the neck 4 of a dual-cartridge 1, leaving the protruding cartridge nozzle 2 exposed.

Figure 2:
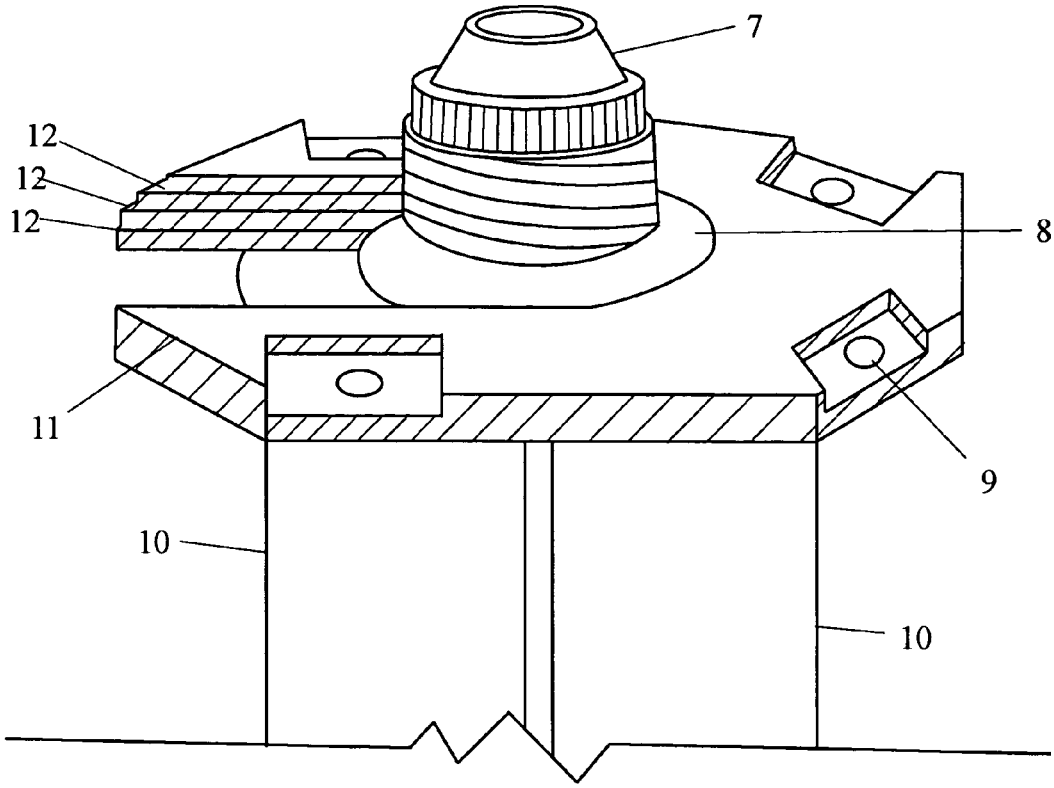
FIGS. 2 and 3 are a front perspective view, and front view, respectively, of a dual-cartridge dispensing gun incorporating a side-loading front catch plate 11 according to a second embodiment of the invention.
Figure 3:
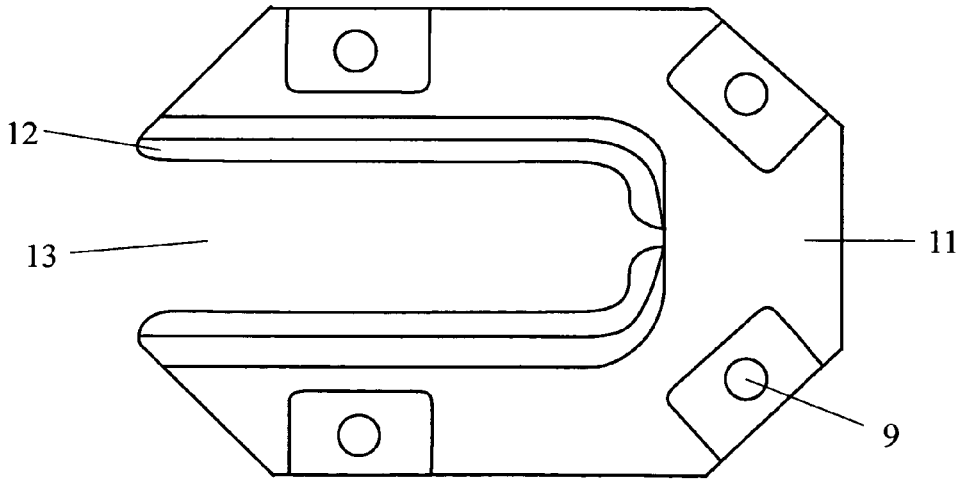

FIGS. 2 and 3 are a front perspective view, and front view, respectively, of a dual-cartridge dispensing gun incorporating a side-loading front catch plate 11 according to a second embodiment of the invention. The side-loading front catch plate 11 is similar to that of FIG. 1, but is generally C-shaped to define a laterally-accessible yoke for receiving the neck 4 of the dual-cartridge 1, leaving the protruding cartridge nozzle 2 exposed.

In either embodiment the front catch plate 5, 11 may be economically formed of molded plastic or metal, although machined metal or other durable materials are also acceptable. The front catch plates 5, 11 may be installed during the original manufacture of the gun, or may be distributed separately as a retrofit part. If installed as a retrofit part, the catch plates 5, 11 are installed simply by screwing them onto the application end of the dispensing gun through threaded screw holes 9 (see FIG. 2). The yokes of both top- and side-loading front catch plates 5, 11 are defined by a tongue-and-groove track or "channeled edge 12" around its periphery. It is this channeled-edge 12 as seen in FIG. 3 that seats the neck 4 of the dual-cartridge 1. Thus, if the neck 4 fits the yoke 5, 11 as is, the neck 4 slides securely into the yoke 5, 11. On the other hand, both top- and side-loading front catch plates 5, 11 are adapted to accept a variety of plastic inserts 3 by which they are able to accommodate virtually any commercially available form, shape and size of dual caulk cartridge. Each odd- sized commercially-available dual caulk cartridge will have an associated plastic insert 3, the interior configuration of the insert 3 specifically conforming to that particular dual caulk cartridge. The exterior configuration of the inserts 3 are all uniformly configured to mate with the channeled-edges 12 of the front catch plates 5, 11. Each plastic insert 3 has a peripheral locking channel 14 that cooperates with the channeled-edge 12 of catch plates 5, 11.

Figure 5:
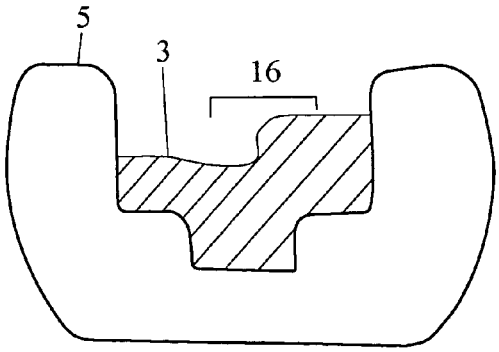
FIGS. 5 and 6 are front views of two alternative plastic inserts 3 with different cradle 16 configurations.
Figure 6:
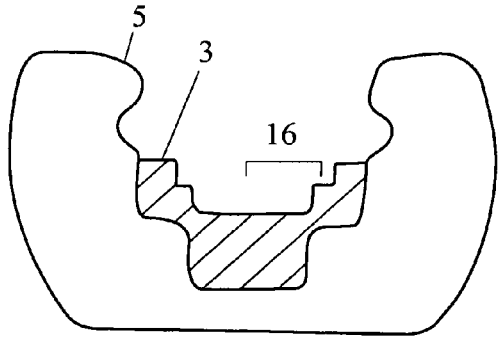

FIGS. 5 and 6 are front views of two alternative plastic inserts 3 for the top-loading front catch plate 5 of FIG. 1, including two different cradle sections 16 that conform to the neck 4 of the cartridge to be used. The inserts may be molded with any variety of cradle 16 configurations as needed, depending on the neck 4 configuration of the dual cartridge to be employed.

Figure 7:
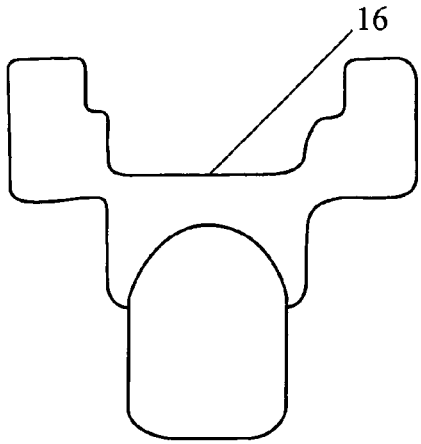
FIGS. 7 and 8 are a front and side perspective view, respectively, of yet another plastic insert 3 for the top-loading front catch plate 5 of FIG. 1.
Figure 8:
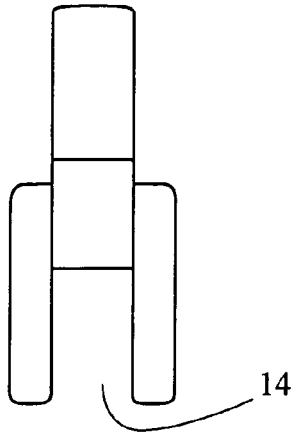

FIGS. 7 and 8 are a front and side perspective view, respectively, of another exemplary plastic insert 3 for the top-loading front catch plate 5 of FIG. 1, showing the peripheral locking channel 14 that cooperates with the channeled-edge 12 of catch plate 5, and cradle section 16 that conforms to the neck 4 of the cartridge to be used. In operation, the proper plastic insert 3 is slid down onto the channeled-edge 12 of the top-loading front catch plate 5, and then the cartridge neck 4 is then seated thereon. The cooperating channeled-edge 12 and locking channel 14 secures the plastic insert 3 onto the top-loading front catch plate 5. The dual cartridges 1 are seated in the barrels 6 and are ready for application.

Figure 4:
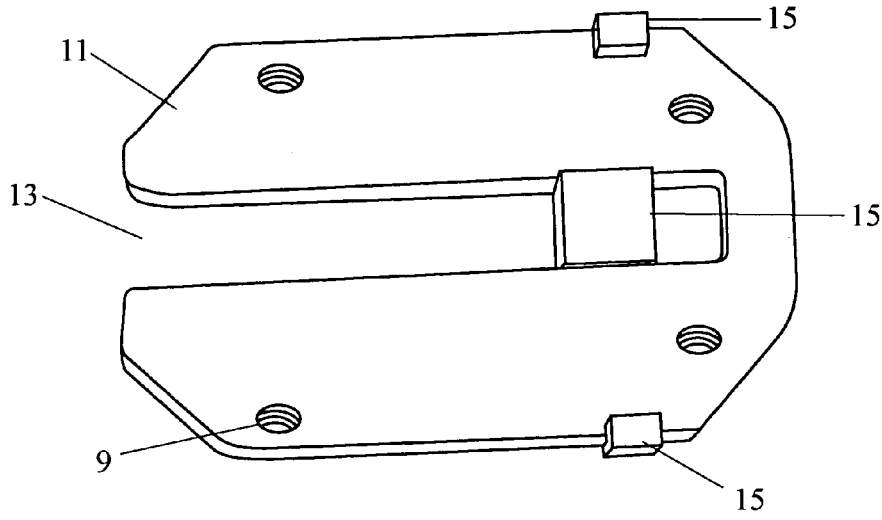
FIG. 4 is a back view of the side-loading front catch plate 11 equipped with an adjustable centering stop 15.
Figure 9:
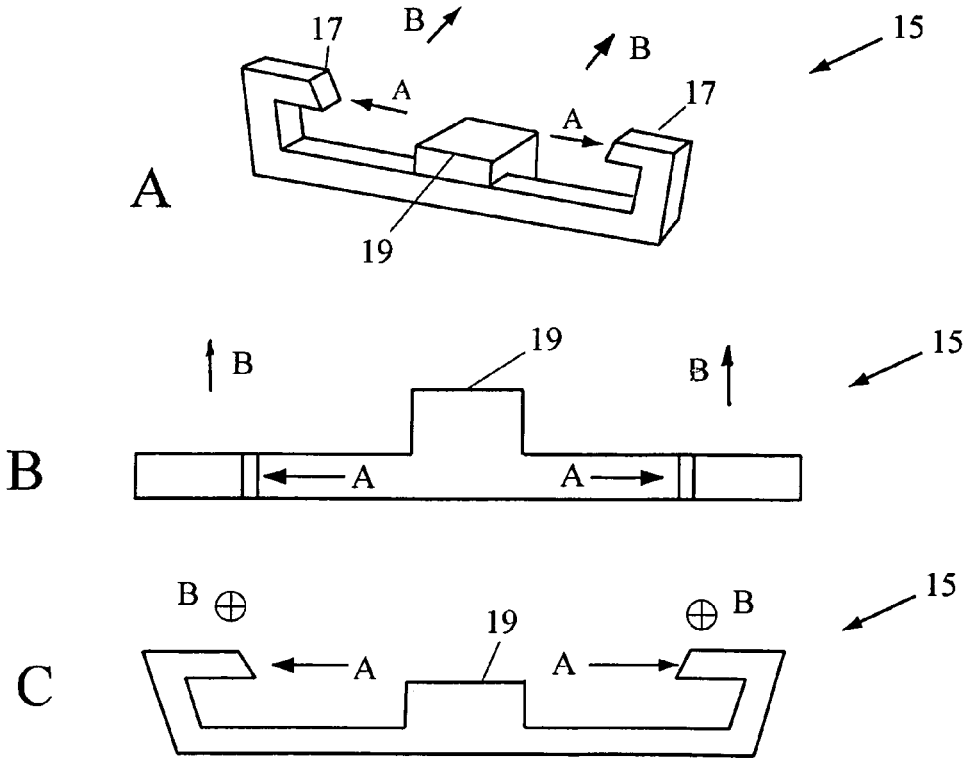
FIGS. 9A–C are a perspective view, side view and top view, respectively, of the adjustable centering stop 15.

Operation of the side-loading front catch plate 11 (FIGS. 2, 3, and 4) is substantially the same as described above except from a lateral orientation. In addition, the side-loading front catch plate 11 is preferably equipped with an adjustable centering stop 15 (FIG. 4). The adjustable centering stop 15 is illustrated in FIGS. 9A–C, which are a perspective view, side view and top view, respectively. The adjustable centering stop 15 generally comprises a slidable clip with opposing gripping tabs 17 and a support block 19. The tabs 17 of the adjustable centering stop 15 are pressed outwardly, as indicated by the 'A' arrows, to allow the stop 15 to be slid onto the side-loading front catch plate 11. The tabs 17 are then released, which causes pressure to be applied, in turn causing the adjustable centering stop 15 to remain in place. The adjustable centering stop 15 may be slidably adjusted within the yoke of the side-loading front catch plate end 11, causing support block 19 to bear against and center the cartridge neck 4 as needed. In this way the adjustable centering stop 15 holds the cartridge neck 4, selectively centers it, and thus the dual cartridges 1 in place for application.

It should be readily understood that both of the above-described front catch plates 5, 11 secure a variety of cartridge necks 4 and thereby facilitate accurate application of compound such as epoxy or the like. The front catch plates 5, 11 also accommodate the various form, shape and size of neck of commercially available dual cartridges. Moreover, the front catch plates 5, 11 can be economically manufactured of metal or molded plastic and installed onto a dual barrel dispensing gun at minimal additional cost of time and materials, and they can be used in conjunction with all of manual, pneumatic or battery power-operated caulking guns.

Having now fully set forth the preferred embodiments and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth herein.

I claim:

1. In a dispensing gun for dispensing compound from a variety of dual cartridges having various neck shapes and sizes, the dispensing gun including a barrel section for seating a dual cartridge, an improvement comprising:

a front catch plate attached forwardly of the barrel section of said dispensing gun, the front catch plate being formed with a peripheral edge interrupted by a yoke; and a plurality of inserts selectively installable into the yoke of said front catch plate, each insert having a having a cradle adapted to conform to the neck of one of said variety of dual cartridges for seating the neck therein, and a locking channel for insertion onto the edge of said front catch plate within said yoke, said plurality of inserts having different cradle sizes for seating and supporting a corresponding variety of dual cartridge necks thereon.

2. The dispensing gun according to claim 1, wherein said yoke is substantially U-shaped.

3. The dispensing gun according to claim 1, wherein said yoke is substantially C-shaped.

4. The dispensing gun according to claim 1, wherein the peripheral edge of the front catch plate within said yoke is defined by a tongue-and-groove channel.

5. The dispensing gun according to claim 4, wherein said plurality of inserts are each defined by a peripheral track for cooperation with the tongue-and-groove channel along the peripheral edge of the front catch plate within said yoke.

6. A front catch plate for a dispensing gun comprising:

a yoke and a plurality of inserts selectively installable on said yoke, each insert having a different cradle section for seating and supporting a corresponding variety of dual cartridges thereon, further comprising an adjustable centering stop that slides laterally onto the front catch plate from the open end until pressing against the cartridge neck, securing the cartridge neck in place for application.

* * * * *